United States Patent [19]

Acevedo

[11] 4,341,292

[45] Jul. 27, 1982

[54] FREELY-REVERSIBLE TORQUE-APPLYING HANDLE ASSEMBLY WITH DIRECTION OF TORQUE-APPLICATION SELECTION

[76] Inventor: Ignacio Acevedo, 4066 Fenwick Rd., Columbus, Ohio 43220

[21] Appl. No.: 182,142

[22] Filed: Aug. 28, 1980

[51] Int. Cl.[3] ..... B25B 15/00

[52] U.S. Cl. ..... 192/43; 81/58.3; 145/76; 192/41 S; 192/48.92; 192/56 C

[58] Field of Search ..... 192/41 S, 43, 48.92, 192/56 C, 81 C; 145/76, 70; 81/467, 477, 58.3

[56] References Cited

U.S. PATENT DOCUMENTS

| | | | |
|---|---|---|---|
| 1,553,850 | 9/1925 | Davis | 81/58.3 |
| 1,704,062 | 3/1929 | Starkey | 192/43 |
| 2,468,193 | 4/1949 | Goff | 192/56 C |
| 2,533,973 | 12/1950 | Starkey | 192/56 C X |
| 2,595,213 | 4/1952 | Raynor | 192/43 X |
| 2,626,029 | 1/1953 | Gutterman | 192/41 S X |
| 2,792,094 | 5/1957 | Baldwin et al. | 192/43 |
| 3,220,523 | 11/1965 | Hepner | 192/41 S X |
| 4,143,693 | 3/1979 | Acevedo | 145/76 |
| 4,210,185 | 7/1980 | Acevedo | 145/76 |
| 4,235,133 | 11/1980 | Acevedo | 192/41 S X |

*Primary Examiner*—Rodney H. Bonck
*Attorney, Agent, or Firm*—William V. Miller

[57] ABSTRACT

A tool handle assembly embodying an axially-extending torque-applying tool shank disposed for axial and rotative movement in a double-spring clutch in a handgrip. The clutch consists of two axially-aligned springs disposed in opposite ends of a chamber formed in the handgrip. The shank is movable axially within a connecting sleeve arrangement provided between the shank and the springs and the springs and the handgrip which is such that when the shank is selectively moved to one extreme axial position and the handgrip is turned, the one spring clutch will apply torque to the shank and permit free reversal in the opposite direction; when the shank is selectively moved to its other extreme position and the handgrip is turned, the other spring clutch will apply torque to the shank in a reverse direction and permit free reversal in the opposite direction; and when the shank is selectively moved to an intermediate position one spring clutch will function to apply torque to the shank when the handgrip is turned in one direction and then the other spring clutch will function to apply torque when it is turned in the opposite direction, there being no free-reversal.

10 Claims, 11 Drawing Figures

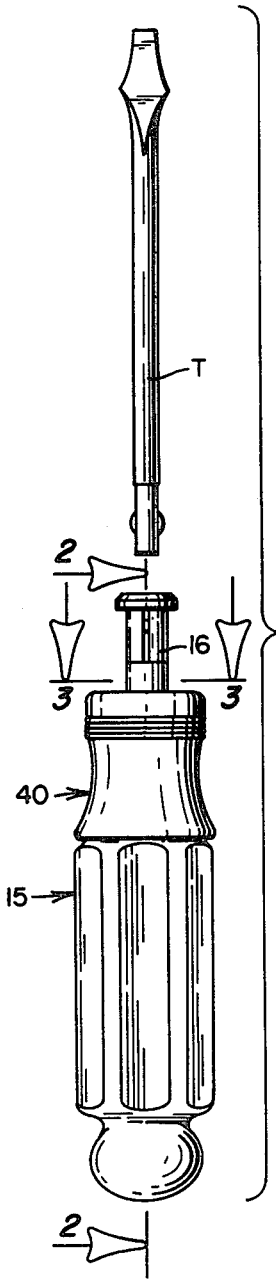
FIG. 1
FIG. 2
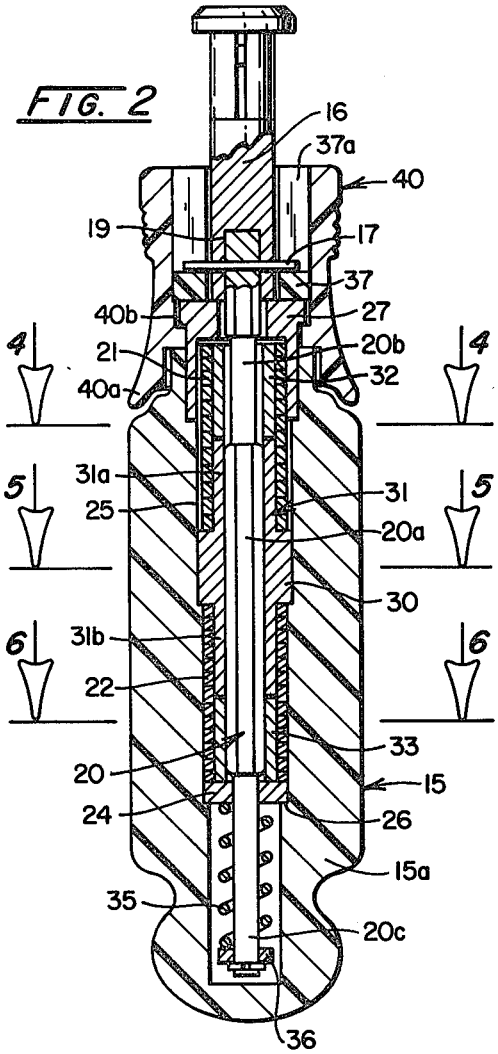
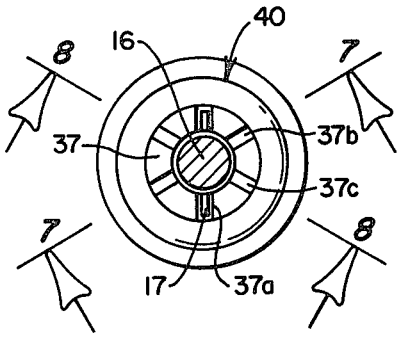
FIG. 3

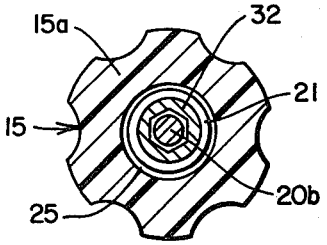
FIG. 4
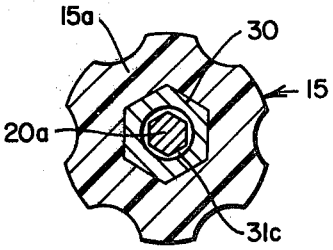
FIG. 5
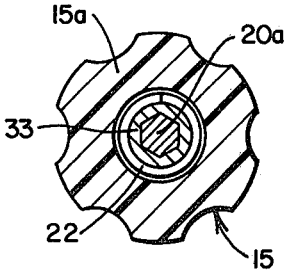
FIG. 6
FIG. 7
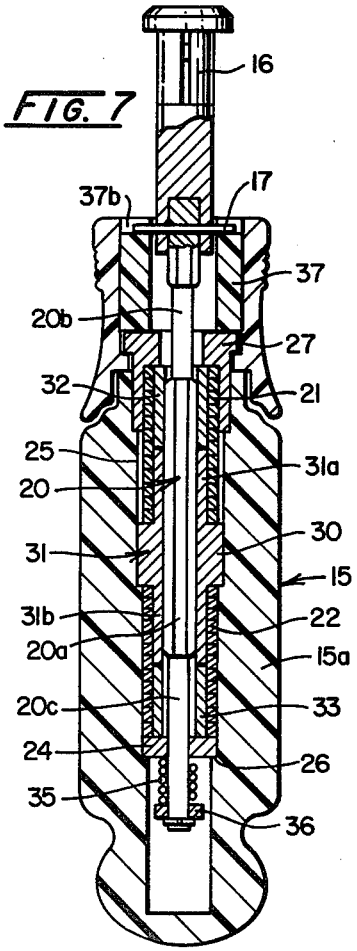
FIG. 8
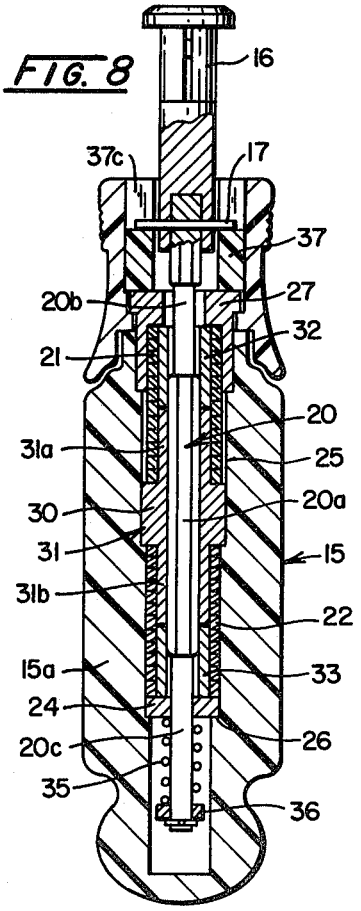

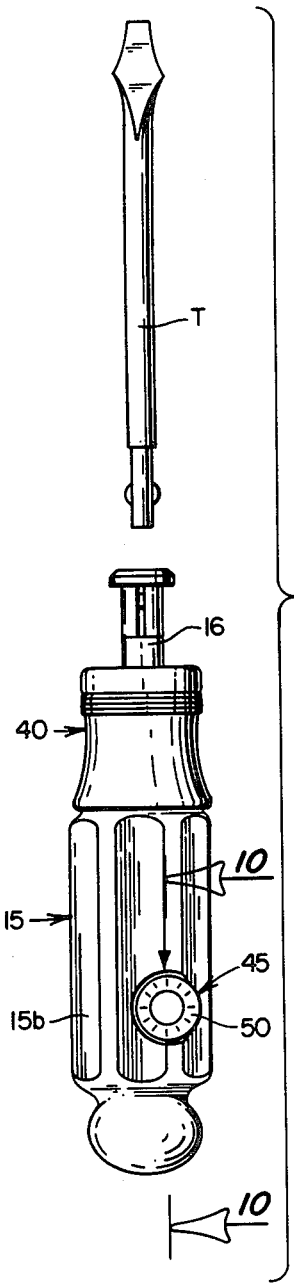
FIG. 9
FIG. 10
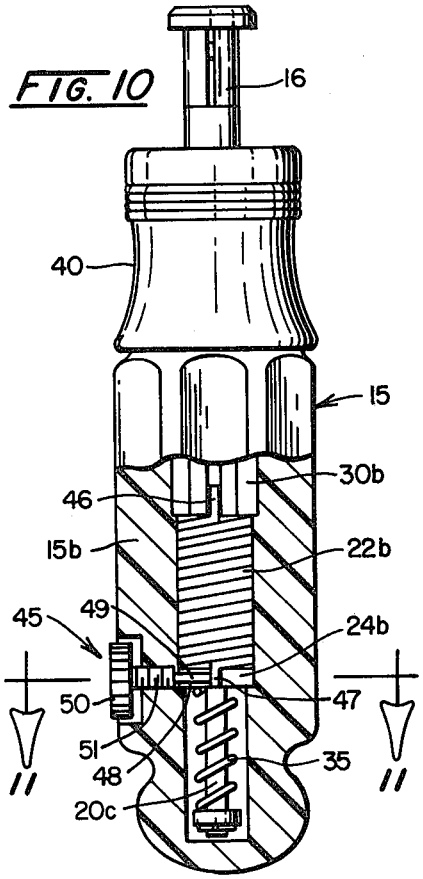
FIG. 11
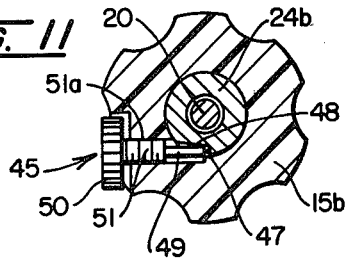

FREELY-REVERSIBLE TORQUE-APPLYING HANDLE ASSEMBLY WITH DIRECTION OF TORQUE-APPLICATION SELECTION

BACKGROUND AND PRIOR ART

In copending application Ser. No. 056,594, now U.S. Pat. No. 4,235,133 there is disclosed a coupling used between a handle and a tool having outwardly-opening tool-receiving sockets at its opposed ends for selectively receiving a tool shank and a separate intermediate torque-applying sleeve having outwardly-opening sockets at its opposed ends for selectively receiving a driving handle shank after it is passed through the cooperative tool socket. A pair of reversely wound springs surround the sleeve and when the handle shank is on one end socket of the sleeve and is turned in one direction, it will drive the tool socket at the other end, but the handle shank and socket can be freely turned in a reverse direction.

The device described above provides a satisfactory double spring-clutch arrangement for driving a tool selectively either in a clockwise or a counterclockwise direction, with free rotation in the opposite direction. However, to change from clockwise to counterclockwise drive, it is necessary to reverse the positions of the driving handle and the tool on the coupling which takes some time and effort. The present invention overcomes this by providing means for selecting the direction of rotation merely be an axial positioning of the tool-carrying shank in the handle assembly.

SUMMARY OF THE INVENTION

According to this invention, a double-spring clutch arrangement is provided in cooperation with a tool-carrying shank mounted in a handgrip. The shank is mounted for axial movement in a connecting sleeve arrangement comprising three axially-aligned sleeves consisting of an intermediate drive sleeve anchored to the handgrip in fixed axial and angular position, and opposed forward and rearward driven sleeves which rotate within the handgrip. The double-spring clutch comprises a pair of springs one of which extends axially over the forward driven sleeve and an axially forward drive portion of the intermediate sleeve, and the other of which extends axially over the rearward driven sleeve and an axially rearward drive portion of the intermediate sleeve. The shank has a drive section of angular cross-section throughout most of its length and the driven sleeves have axial holes or sockets of complemental cross-section which permit axial movement of the shank into the driven sleeves but no rotative movement therein so at that time there is a driving action. However, the shank also has non-driving forward and rearward sections at each end of the driving section which may be selectively moved into the driven sleeves and at that time there will be no driving action on that sleeve. The intermediate sleeve has a plain bore so the driving section of the shank can always rotate therein. The shank is retracted by a compression spring arrangement, into a position so that the intermediate driving section of the shank extends into the rearward driven sleeve. If the handgrip is now turned, rear drive sleeve portion winds up the surrounding spring and causes it to grip the rear sleeve to drive it. This, will cause the rear spring to act as the clutch driving the tool shank clockwise, for example, but permitting free reversal because such axial positioning of the shank also positions its non-driving forward section in the forward sleeve so it will merely rotate in that sleeve and the sleeve will thus have no effect on the surrounding forward clutch spring. Selective advancement of the shank axially against the force of the compression spring to its forwardmost position, causes the intermediate shank driving section to extend into the forward driven sleeve and thereby drive this forward sleeve and intermediate sleeve together. This will cause the outer or forward spring to tighten and act as the clutch driving the tool shank counterclockwise, but permitting free reversal because this axial movement of the shank also moves its non-driving rear section into the rearward sleeve so it will merely rotate in that sleeve and have no effect on the surrounding rear sleeve and spring clutch. Selective shifting of the shank axially into an intermediate position, causes the intermediate angular driving section of the shank to extend into both the inner and outer driven sleeves so that both surrounding spring clutches will function to apply torque in opposite directions while precluding reverse rotation.

BRIEF DESCRIPTION OF THE DRAWINGS

The best mode contemplated in carrying out this invention is illustrated in the accompanying drawings in which:

FIG. 1 is a side elevational view of the torque-applying, freely-reversible tool-driven handle assembly of this invention with the direction of torque-application selection means;

FIG. 2 is an enlarged axial sectional view taken along line 2—2 of FIG. 1;

FIG. 3 is an enlarged transverse section view taken along line 3—3 of FIG. 1;

FIG. 4 is a transverse sectional view taken along line 4—4 of FIG. 2;

FIG. 5 is a transverse sectional view taken along line 5—5 of FIG. 2;

FIG. 6 is a transverse sectional view taken along line 6—6 of FIG. 2;

FIG. 7 is an enlarged axial sectional view taken along line 7—7 of FIG. 3, but with the shank selectively shifted into its forwardmost position;

FIG. 8 is an enlarged axial sectional view taken along line 8—8 of FIG. 3, but with the shank selectively shifted into its intermediate position;

FIG. 9 is a side elevational view of handle assembly similar to that shown in FIG. 1, but provided with a torque-limiting adjustment;

FIG. 10 is an enlarged partial axial sectional view taken on line 10 of FIG. 9; and FIG. 11 is a transverse sectional view taken along line 11—11 of FIG. 10.

DETAILED DESCRIPTION OF THE INVENTION

With specific reference to the drawings, and particularly to FIGS. 1 to 8 inclusive, the present invention is shown as comprising a handle assembly, indicated generally by the numeral 15, for applying driving torque to a selected tool T carried thereby which is shown as a screwdriver but may be various other tools. The tool as shown in FIGS. 1 and 7 is removably carried in a socket member 16 which projects from the forward or leading end of a handgrip 15*a* of suitable material, design and size. The socket or tool-carrying member is keyed or pinned by a transverse pin 17 on the leading or forward end of a shank which is indicated generally by the numeral 20 and which is mounted in the handgrip 15*a* for both axial and rotative controlled movement. The extreme forward end of the shank may be angular and fit into a complemental angular recess for driving the member 16, as indicated at 19 in FIG. 2.

The rotation of the shank 20 is controlled by a double-spring clutch arrangement consisting of the forward spring 21 and rearward spring 22 which are axially-aligned and are disposed in opposite ends of a substantially cylindrical or tubular chamber 25, molded or otherwise formed in the handgrip 15*a*. The rearward end of rearward spring 22 abuts a washer 24 which engages an annular shoulder 26 at the rear end of chamber 25. The forward end of spring 21 is engaged by a retainer collar 27 which is pressed-fit into the adjacent open end of chamber 25. It will be noted that shank 20 will rotate in the retainer opening as well as be free to move axially into and out thereof.

To operatively connect the shank 20 and clutch springs 21 and 22 together, a sleeve arrangement is provided therebetween which consists of three axially-aligned sleeves in surrounding relationship to the shank. These sleeves comprise an intermediate driving sleeve 31, a forward driven sleeve 32, and a rearward driven sleeve 33. The driving sleeve 31 is anchored in the handgrip so it will not move axially or rotate therein by means of an angular radial enlargement 30, midway of its length, around which the material of the handle is molded or formed. This provides a forward driving sleeve portion 31*a* and a rear driving sleeve portion 31*b* which are axially separated by enlargement 30 and are in engagement with the respective axially-aligned front and rear driven sleeves 32 and 33. Thus, clutch spring 21 will extend axially rearwardly over sleeve 32 and sleeve portion 31*a* and frictionally embrace them, its rear end abutting enlargement 30 of sleeve 31. Clutch spring 22 will extend forwardly over rear sleeve 33 and sleeve portion 31*b*, its forward end abutting the enlargement 30.

The shank 20, as previously indicated, is mounted for axial movement in the aligned sleeves 31, 32 and 33 and its leading or forward extremity carries the tool holder 16. It includes an axially intermediate drive section 20*a* of angular-cross section, a forward non-driving reduced cylindrical section 20*b*, and a rearward non-driving reduced cylindrical section 20*c*. The openings extending through the driven sleeves 32 and 33 are of angular form complemental to that of the angular shank drive section 20*a* which permit relative axial sliding movement but preclude relative rotative movement. The opening 31*c* in the driving sleeve 31 is a plain bore so that angular portion 20*a* (FIG. 5) can rotate as well as slide axially therein. Also, it will be noted that angular portion 20*a* is of an axial extent equal to that of sleeve 31 plus that of sleeve 32 or 33.

A compression spring 35 surrounds the rear shank section 20*c* between washer 24 and a stop washer 36 on the rear extremity of the shank to tend to keep the shank retracted to a rear position in the handgrip 15*a* (FIG. 2). This position is determined by pin 17 extending diametrically from member 16 and serving as a stop pin by engaging a slotted collar insert 37 which is pressed-fit in a spinner 40 and is caused by the compression spring 35 to engage the collar 37. The spinner 40 is mainly of tubular form but has a flared skirt 40*a* that fits around the forward end of handgrip 15*a*, a cooperating shoulder arrangement 40*b* serving to normally prevent axial displacement of the spinner. The spinner 40 will rotate with the member 16 and the shank 20 which carries it. However, the shank can be moved axially relative thereto. This is because the connection between the spinner and shank is accomplished by means of fitting the pin 17 selectively in any of the three pairs of opposed forwardly and rearwardly extending outwardly opening slots 37*a*, 37*b* and 37*c* formed in the peripheral wall of the spinner insert 37 at angularly spaced positions, as shown best in FIGS. 2, 3, 7 and 8. The pair 37*a* is the deepest and will permit the tool shank 20 to be retracted completely, (FIG. 2); the pair 37*b* is the most shallow and will permit the tool shank 20 to be extended completely, (FIG. 7); whereas the pair 37*c* is of intermediate depth and will position the shank at an intermediate axial position (FIG. 8). The spinner 40 has its outer surface formed to provide an annular concave groove to facilitate engagement with the fingers as it is used to hold the tool on the work and the handgrip 15*a* is manipulated. It will be noted that although the spinner is fixed to the tool holder 16 and shank 20, it is rotatable relative to handgrip 15*a*.

Assuming that parts of the handle assembly 15 are in the condition shown in FIG. 2, the compression spring 35 will retract the shank 20 and tool holder 16 carried thereby to its rearwardmost position. To permit this as indicated above, the pin 17 must have been set in the pair of deepest slots 37*a* carried by the member 37 in the spinner 40. The compression spring 35 pulls the shank 20 rearwardly in the aligned sleeves 31, 32, and 33, so that angular drive portion 20*a* of the shank extends into rear sleeve 33. Thus, rear drive sleeve portion 31*b* and rear sleeve 33 are, in effect, connected together and will act on the surrounding clutch spring 22. Consequently, when handgrip 15*a* is turned, for example clockwise, the spring 22 will be wound up by sleeve 31 and tightened around sleeve portion 31*b* and sleeve 33, connecting the handgrip 15*a* to the shank 20 and applying torque to the tool holder 16. Free reversal of the handgrip 15*a* will be permitted by unwinding of clutch spring 22 caused by reverse rotation of sleeve 31 and slipping of the sleeve 33 and sleeve portion 31*b* therein. The other spring clutch 21 will not interfere with either the drive rotation or reversal, because, at this time, non-driving end 20*b* of the shank 20 is in the forward sleeve 32 and angular shank portion 20*a* will rotate in the bore 31*c* in sleeve 31. To hold the tool on the work, during drive and reversal, the spinner collar 40 may be engaged with the fingers of one hand while the handgrip 15*a* is gripped with the other hand.

If it is desired to drive the tool T in the reverse direction, counterclockwise, and permit free reversal in the opposite direction, the pin 17 must be set in the pair of most shallow slots 37*b* as shown in FIG. 7. This will extend or advance the shank 20, and the tool holder 16 carried thereby, to its forwardmost position. The compression of spring 35 permits this. Axial forward movement of shank 20 causes the angular drive portion 20*a* thereof to extend into the forward sleeve 32 so as to, in effect, connect it to forward drive sleeve portion 31*a*. When the handgrip 15*a* is turned counterclockwise, the forward sleeve portion 31*a* will wind up the surrounding clutch spring 21, and tighten it on the forward sleeve 32 and, thereby, connect the handgrip 15*a* to the shank 20 and apply torque to the tool holder 16. Free reversal of the handgrip 15*a* is permitted by unwinding of clutch spring 22 caused by reverse rotation of sleeve 31 and slipping of the sleeve 32 and sleeve portion 31*a* therein, and since non-driving portion 20c of the shank is positioned at this time in the rearwardmost sleeve 33 and angular portion 20a is in the associated bore and the rotation of the shank, therefore, will have no effect on clutch spring 22. It will be noted that sleeve 33 is at the rear end of spring 22 whereas sleeve 32 is at the forward end of spring 21, causing a reverse clutching action.

If it is desired to use the handle assembly as a fixed handle, the shank 20 is shifted to the position indicated in FIG. 8 by setting the pin 17 in the pair of slots 37c of the spinner which are of intermediate depth. This will position the shank 20 axially in the handgrip 15a so that its angular driving section 20a has its opposite ends extending respectively into the forward sleeve 32 and rearward sleeve 33. This will, in effect, connect the two sleeves as a single sleeve. Consequently, the two opposed spring clutches 21 and 22 will cooperate to prevent relative rotation of the handgrip and shank in either direction. Turning in one direction of the handgrip will cause spring 21 to function to apply torque and turning in the other direction will cause spring 22 to function to apply torque so there will be no free reversal. In one instance, the sleeve 32 serves to tighten the clutch spring 21 about sleeve portion 31a and in the other, the sleeve 33 serves to tighten the clutch spring 22 around the sleeve portion 31b.

FIGS. 9, 10 and 11 show the same assembly as illustrated and described before except that an additional feature of means for limiting the driving torque applied is provided in combination with one of the spring clutches, this being indicated generally by the numeral 45. It is shown in cooperation with the rearward clutch which is the driving clutch, for example, when the tool is a screwdriver, it being understood that it would not be needed with the forward clutch used for removal of the screw, although it could be provided there also.

In this instance, the two clutches and associated connecting sleeve structures in the handgrip 15b are exactly the same as before except that the rear clutch spring 22b has a forward straight anchoring extremity 46, disposed in an anchoring slot in the angular enlargement 30b anchored in the handgrip 15b. The opposite extremity 47 is also straight but extends into a notch 48 formed tangentially in washer 24b. The reduced inner end 49 of setscrew 50 extends into this notch and has an outer portion 51 tapped in a bore 51a which is also tangential to washer 24b and aligns with notch 48. By turning the setscrew 50 inwardly, the clutch spring 22b is unwound slightly to permit slippage on the sleeves it surrounds when a certain torque is reached. Thus, the maximum torque applied to shank 20, in the tool-driving direction, can be varied by selectively setting the setscrew 50.

It will be apparent from the above that this invention provides a tool handle assembly with a double-spring clutch controlling a tool-carrying shank to apply driving torque thereto in a selected direction and be freely-reversible in an opposite direction. The assembly is such that the direction of rotation of the shank to apply the torque can be selected merely by selectively setting the shank at different axial positions to select the particular spring-clutch which is to function to apply the torque. If no free-reversal is desired, an axial position of the shank is selected where one spring-clutch applies the torque in one direction and the other in the opposite direction and, thus, free reversal in either direction is precluded.

Having thus described this invention what is claimed is:

1. A tool-handle assembly comprising a handgrip having a tool-shank disposed for axial and rotative movement in a double-spring clutch carried thereby; said double spring clutch comprising two axially-aligned springs disposed in a chamber formed in the handgrip; and a connecting sleeve arrangement between the shank and the clutch springs and the handgrip and the clutch springs whereby selective axial movement of the shank will selectively actuate the clutch springs to apply torque to the tool shank in one direction and permit free-reversal in the opposite direction or will apply torque in both directions.

2. An assembly according to claim 1 in which the sleeve arrangement comprises three axially aligned sleeves in said chamber consisting of an intermediate drive sleeve anchored to the handgrip in fixed axial and angular position and having axial forward and rearward drive portions, and opposed forward and rearward end driven sleeves which rotate within a chamber, the one clutch spring extending axially over the forward driven sleeve and the axial forward drive portion of the intermediate sleeve and the other clutch spring extending axially over the rearward driven sleeve and the axial rearward drive portion of the intermediate sleeve, said shank having a drive section at each end which can be selectively shifted into the adjacent forward or rearward end driven sleeve to selectively connect the end sleeve and the adjacent drive portion of the intermediate sleeve.

3. An assembly according to claim 2 in which the tool shank has a drive section of angular cross-section and the forward and rearward end driven sleeves have sockets of complemental angular cross-section for receiving the tool shank drive section.

4. An assembly according to claim 3 including means provided for setting the maximum drive torque applied by one of said clutch springs, said one spring having its one end anchored to said enlargement and its opposite end free, a setscrew engaging said opposite end to unwind the spring as desired, said setscrew being tapped in a bore in said handgrip substantially tangential to said clutch spring.

5. An assembly according to claim 3 in which each end of the tool shank has a non-driving section adapted to be disposed in the adjacent end driven sleeve when the shank is moved axially to position its driving section in the end driven sleeve at the opposite end, the angular driving section of the shank being rotatable in a bore in the intermediate sleeve and being of a length equal to that sleeve plus one of the end driven sleeves.

6. An assembly according to claim 5 in which the intermediate sleeve has a radial enlargement midway of its length achored in the handgrip, the two clutch springs abutting opposite sides of the enlargement, and a compression spring arrangement for keeping the tool shank in a forward advanced position in the handgrip, comprising a compression spring surrounding the rear non-driving end of the shank and disposed between stops carried respectively by the shank and the handgrip.

7. An assembly according to claim 6 comprising means for setting the tool shank in different axial positions; said means comprising a flanged collar mounted on the forward end of the handgrip for rotation with the tool shank and relative to the handgrip; said collar having diametrically-extending slots opening forwardly and said tool shank extending into the collar and having a diametrically extending pin carried thereby which can be positioned in any of said slots.

8. An assembly according to claim 7 in which the collar is surrounded by a spinner of substantially tubular form having a concave annular finger-receiving groove.

9. An assembly according to claim 1 in which means is provided for setting the maximum torque applied by at least one of the clutch springs, said means comprising a member carried by the handgrip and engageable with one end of the spring to unwind it a selected amount.

10. A tool-handle assembly comprising a handgrip and a tool-carrying shank mounted in the handgrip for rotative movement under control of a spring-clutch, said spring-clutch including a spring which tightens around a shank-driving sleeve to apply torque to it and the cooperating tool shank, and means for setting the maximum torque applied by said clutch spring; said clutch spring having its one end anchored to said handgrip and its opposite end free, and a setscrew engaging said opposite end to unwind it from said sleeve as desired, said setscrew being tapped in a bore in said handgrip substantially tangential to said clutch spring.

* * * * *